US006532377B1

(12) United States Patent
Terashima et al.

(10) Patent No.: US 6,532,377 B1
(45) Date of Patent: Mar. 11, 2003

(54) PLANAR FILTER AND FILTER SYSTEM USING A MAGNETIC TUNING MEMBER TO PROVIDE PERMITTIVITY ADJUSTMENT

(75) Inventors: Yoshiaki Terashima, Yokosuka (JP); Hiroyuki Fuke, Kawasaki (JP); Hiroyuki Kayano, Yokohama (JP); Hisashi Yoshino, Machida (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 4 days.

(21) Appl. No.: 09/654,701

(22) Filed: Sep. 1, 2000

(30) Foreign Application Priority Data

Sep. 29, 1999 (JP) ..... 11-276626

(51) Int. Cl.[7] ..... H01P 1/203; H01B 12/02

(52) U.S. Cl. ..... 505/210; 333/99 S; 333/205; 505/700; 505/701; 505/866

(58) Field of Search ..... 333/205, 235, 333/99 S; 505/210, 211, 700, 701, 866

(56) References Cited

U.S. PATENT DOCUMENTS

| | | | | |
|---|---|---|---|---|
| 5,949,311 A | | 9/1999 | Weiss et al. | 333/202 |
| 5,965,494 A | | 10/1999 | Terashima et al. | 505/210 |
| 6,049,726 A | * | 4/2000 | Gruenwald et al. | 333/99 S |
| 6,094,588 A | * | 7/2000 | Adam | 333/99 S |

FOREIGN PATENT DOCUMENTS

DE 196 20 932 8/1997

OTHER PUBLICATIONS

Q. X. Jia, et al., Applied Physics Letters, vol. 74, No. 11, pp. 1564–1566, XP–002160879, "Integration of Nonlinear Dielectric Barium Strontium Titanate with Polycrystalline Yttrium Iron Garnet", Mar. 15, 1999.

S. Hontsu, et al., Superconductor Science Technology, vol. 12, pp. 836–839, XP–000986832, "Preparation of All–Oxide Ferromagnetic/Ferroelectric/Superconducting Heterostructures for Advanced Microwave Applications", Jun. 21, 1999.

D. Oates, IEEE MTT–S International Microwave Symposium & Exhibition, pps. 109–136, "Technologies for Tunable Microwave Systems," Jun. 8, 1998.

D.E. Oates, et al., IEEE Transactions on Applied Superconductivity, vol. 9, No. 2, pps. 4170–4175, "Magnetically Tunable Superconducting Resonators and Filters," Jun. 1999.

* cited by examiner

*Primary Examiner*—Benny T. Lee
(74) *Attorney, Agent, or Firm*—Oblon, Spivak, McClelland, Maier & Neustadt, P.C.

(57) ABSTRACT

There is disclosed a planar filter which can variably control a pass frequency band with a high precision and which is superior in skirt property and little in ripple. A planar filter member and tuning member are disposed opposite to each other via a predetermined gap. The filter member is structured in such a manner that an input/output portion formed of a superconductor and a plurality of resonance elements are formed on a substrate. The tuning member is structured in such a manner that on the surface of a magnetic plate with a permeability changing by an applied magnetic field, a plurality of dielectric thin films, and a plurality of electrodes for applying electric fields to the dielectric thin films are arranged. Each of the dielectric thin films is disposed in a position opposite to a gap between the resonance elements of the filter member, or a gap between the filter member and the input/output portion. By applying a voltage between the electrodes, an effective permittivity $\in$ of the gap between the resonance elements, or the gap between the resonance element and the input/output portion is variably controlled, and the skirt property and ripple are adjusted. Moreover, a resonance frequency of the resonance elements, a coupling between the resonance elements, and a coupling between the resonance element and the input/output portion may be individually and independently controlled.

19 Claims, 9 Drawing Sheets

PLANAR FILTER AND FILTER SYSTEM USING A MAGNETIC TUNING MEMBER TO PROVIDE PERMITTIVITY ADJUSTMENT

CROSS REFERENCE TO RELATED APPLICATIONS

The subject application is related to subject matter disclosed in Japanese Patent Application No. H11-276626 filed on Sep. 29, 1999 in Japan to which the subject application claims priority under Paris convention and which is incorporated herein by reference.

BACKGROUND OF THE INVENTION

1. Field of the Invention

The present invention relates to a planar filter constituted by disposing a filter member opposite to a tuning member, particularly to a technique of using a superconductor as a filter material for use in a communication apparatus and the like.

2. Related Background Art

In a communication apparatus for performing information communication by radio or cable, a filter for extracting only a desired frequency band is an important constituting component. To realize the effective use of a frequency, and energy savings, a filter superior in attenuation property and small in insertion loss is demanded.

To satisfy such a demand, a resonance element high in a Q value is necessary as a filter constituting element. As one technique of realizing the resonance element with a high Q value, there has been proposed a technique of using a superconductor as a conductor constituting the resonance element, and using a material with a very low loss such as sapphire or MgO in a substrate. In this technique, a Q value of 10000 or more can be obtained, and a resonance property becomes improved. On the other hand, there is a problem that the resonance property has to be adjusted with a high degree of accuracy when designing and making the filter.

That is, by a slight dispersion of permittivity of the substrate or a slight processing error of the conductor during processing, the resonance property largely changes, and a desired filter property cannot be obtained. Moreover, even when the desired filter property is obtained, there is also a problem that a deviation is generated in the filter property of variation with time or ambient temperature change.

On the other hand, a technique of utilizing the aforementioned high Q value and directly filtering a high frequency signal of a GHz band is proposed in order to omit a frequency converter and realize cost reduction. Also in this case, needless to say, the resonance property of the resonance element has to be highly precisely adjusted, but if an arbitrary frequency can be selected with one filter by positively changing a resonance frequency, a filter constitution can be simplified, and the cost reduction can be achieved.

Additionally, as a technique of eliminating the aforementioned filter property deviation, for example, there is a technique of disposing, on the resonance element, a dielectric whose permittivity changes depending upon voltage, and disposing a voltage applying electrode in the vicinity of the dielectric.

In this technique, by variably controlling an electrode arrangement place and the applied voltage, the permittivity can locally and independently be changed. As a result, this enables individual and independent adjustments of: (1) the resonance frequency of the resonance element, (2) coupling between the resonance elements, and (3) coupling between the resonance element and input/output portion, which are usually necessary for tuning a pass frequency band of the filter. Specifically, the pass frequency band be can variably controlled, and a skirt property and ripple can be adjusted so that desired properties are obtained. Here, the skirt property indicates rise and fall properties of both the sides of the pass frequency band, and the ripple indicates a property recess degree in the pass frequency band. Usually, it is preferable that the skirt property be steep and the ripple be small.

However, in a conventional technique, the dielectric for changing the permittivity, and the electrode for applying the voltage are essential constituting elements, losses by the dielectric and electrode lowers the Q value of the resonance element down to several hundreds or less, and it is difficult to obtain the resonance element and filter superior in attenuation property and small in insertion loss.

Another technique is to dispose, on a resonator of a micro-strip structure, a magnetic (YIG) plate whose permeability changes in accordance with an applied magnetic field, and uniformly apply the magnetic field to the plate from the outside in order to change the resonance frequency.

In this technique, as compared with the aforementioned dielectric control system, no electrode is necessary, a YIG loss is smaller than that of the dielectric, and the Q value of the resonance element can therefore be improved by a factor of ten. However, when this technique is applied to tune the filter property, only the uniform magnetic field can be applied to the respective resonance elements and between the resonance elements or to the input/output portion, the individual and independent adjustments of the aforementioned adjustments (1) to (3), necessary for tuning the filter pass frequency band, are therefore impossible, and there is a problem that changing of the pass frequency band deteriorates the skirt property and ripple.

SUMMARY OF THE INVENTION

The present invention has been developed in consideration of the aforementioned problems, and an object thereof is to provide a planar filter which can variably control a pass frequency band with a high precision, and which is superior in skirt property and in ripple property.

Another object of the present invention is to provide a planar filter which can individually and independently adjust a resonance frequency of a resonance element as a filter constituting component, coupling between the resonance elements, and coupling between the resonance element and an input/output portion.

Further object of the present invention is to provide a planar filter which can tune a pass frequency band at a high speed and in a broad range with a simple constitution without sacrificing a low loss property of a superconductor.

To achieve the aforementioned objects, there is provided a planar filter comprising:

- a filter member in which a plurality of resonance elements of superconductor thin films and input/output portions disposed on both the sides of the resonance elements are formed via gaps on a dielectric substrate; and
- a tuning member which is formed of a magnetic material disposed opposite to the filter member via a predetermined gap and to which a direct-current magnetic field is applied.

The tuning member includes a permittivity adjusting section which can adjust an effective permittivity of at least one of a gap periphery between the resonance elements and a gap periphery between the input/output portion and the resonance element.

According to the present invention, the filter member is disposed opposite to the tuning member, and the tuning member can adjust the effective permittivity of at least one of the gap periphery between the resonance elements in the filter member, and the gap periphery between the input/output portion and the resonance element. Because of this, when changing the filter pass frequency band, the skirt property can be improved, and the ripple can be eliminated.

Moreover, there is provided a planar filter comprising:

a filter member in which a plurality of resonance elements of superconductor thin films and input/output portions disposed on both the sides of the resonance elements are formed via gaps on a dielectric substrate; and a tuning member disposed opposite to the filter member via a predetermined gap.

The tuning member comprises:

a first magnetic material disposed opposite to a gap between the input/output portion and the resonance element;

a second magnetic material disposed opposite to each of the resonance elements;

a third magnetic material disposed opposite to a gap between the resonance elements; and magnetic field generation means for adjusting the permeability of the first to third magnetic materials.

According to the present invention, by disposing the tuning member including the first to third magnetic materials opposite to the filter member, and adjusting the permeability of the first to third magnetic materials, the resonance frequency, the coupling between the resonance elements, and the coupling between the resonance element and the input/output portion can variably be controlled, and the skirt property, ripple, and other filter properties can be improved.

BRIEF DESCRIPTION OF THE DRAWINGS

FIG. 4A is a perspective view of a filter member; and FIG. 4B is a perspective view of a tuning member.

FIG. 11A is a plan view of the filter member; FIG. 11B is a plan view of the tuning member; and FIG. 11C is a sectional view of the planar filter.

DETAILED DESCRIPTION OF THE PREFERRED EMBODIMENTS

A planar filter of the present invention will specifically be described hereinafter with reference to the drawings.

Figure 1:
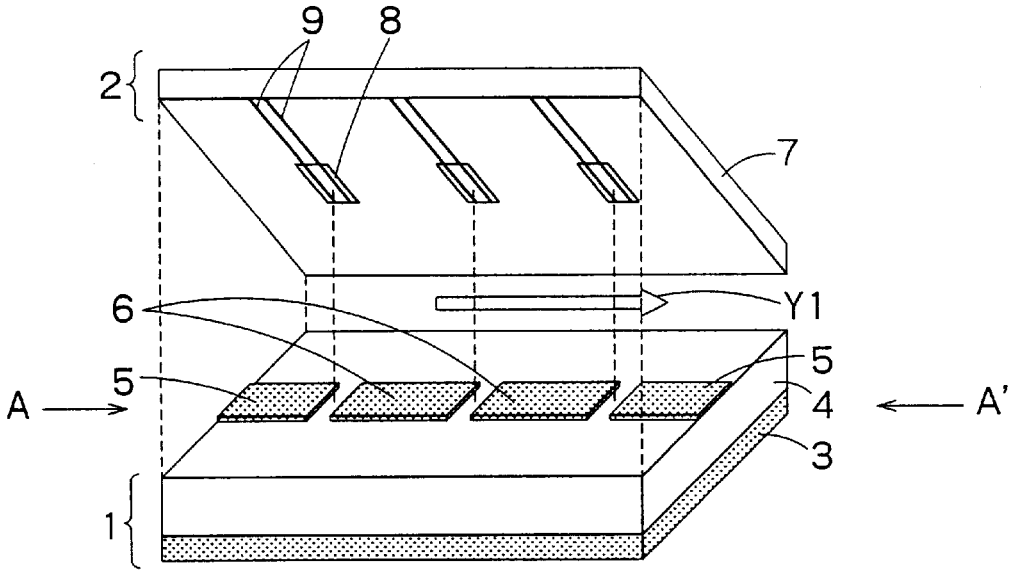
FIG. 1 is a view showing a structure of a first embodiment of a planar filter according to the present invention.
Figure 2:
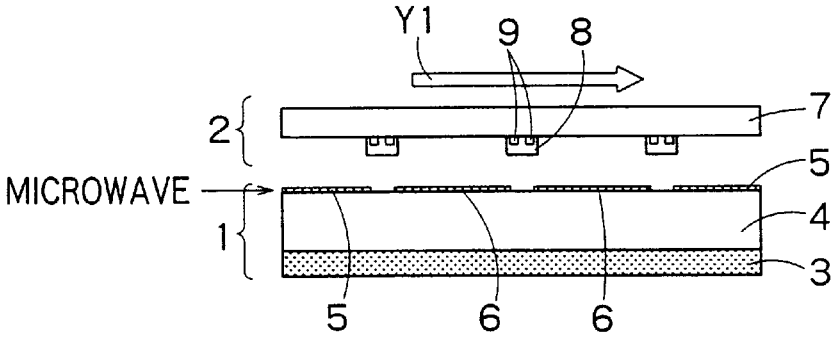
FIG. 2 is a sectional view in an A—A direction of FIG. 1.

FIG. 1 is a view showing a structure of a first embodiment of the planar filter according to the present invention, and FIG. 2 is a sectional view in an A—A direction of FIG. 1.

As shown in FIG. 2, the planar filter of the present embodiment is structured in such a manner that a planar filter member 1 is disposed opposite to a similarly planar tuning member 2 via a predetermined gap.

FIG. 1 shows a state before the filter member 1 is disposed opposite to the tuning member 2, and broken lines of FIG. 1 show vertically overlapped positions when the filter member is disposed opposite to the tuning member.

The filter member 1 of FIG. 1 is a band pass filter of a micro-strip line structure in which a pair of input/output portions 5 formed of superconductors, and a plurality of resonance elements 6 similarly formed of the superconductors are disposed on a substrate 4 whose back surface side is a ground surface 3.

The tuning member 2 of FIG. 1 is structured in such a manner that a plurality of dielectric thin films 8 and a plurality of electrodes 9 for applying an electric field to the dielectric thin films 8 are disposed on the surface (lower surface of FIG. 1) of a magnetic plate 7 whose permeability changes by an applied magnetic field. Each of the dielectric thin films 8 is disposed in a position opposite to a gap between the resonance elements 6 of the filter member 1, or a gap between the resonance element 6 of the filter member 1 and the input/output portion 5.

In FIG. 1, the dielectric thin film 8 and electrode 9 correspond to a permittivity adjusting section, the dielectric thin film 8 corresponds to a dielectric portion, and the electrode 9 corresponds to an electric field generating portion.

As shown in FIG. 2, a microwave as a filtering object is inputted to an input end of the input/output portion 5 of the filter member 1. Moreover, a direct-current magnetic field shown by an arrow Y1 of FIG. 2 is applied from the input/output portion on one end side toward the input/output portion 5 on the other end side. This magnetic field variably controls a filter pass frequency band.

Figure 3:
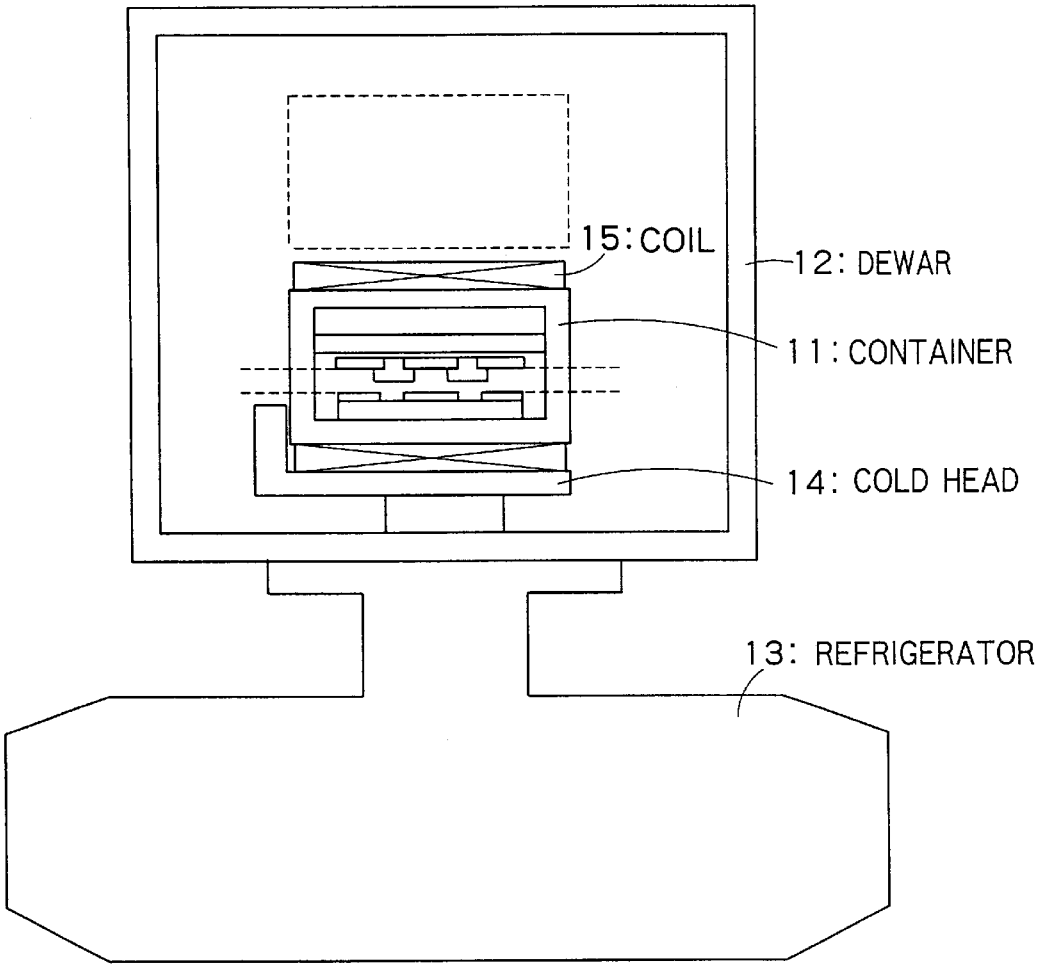
FIG. 3 is a view showing a use state of the filter of FIG. 1.

As shown in FIG. 3, the planar filter of FIG. 1 is contained in a copper (Cu) container 11. The container 11 is further disposed in a Dewar 12. The container 11 is held in thermal contact with a cold head 14 of a refrigerator 13. A coil 15 for generating a magnetic field in a direction of arrow Y1 of FIG. 2 is wound around an outer wall of the container 11.

Moreover, as omitted from FIG. 3, outside the Dewar 12, a voltage applying power source for applying a voltage to the electrode 9 of FIG. 1 and a coil energizing power source for energizing the coil are disposed. By variably controlling the voltage to be supplied to the power sources, a pass frequency, the skirt property or ripple of the filter of FIG. 1 are controlled.

FIG. 3 shows an example in which an amplifier (not shown) at a subsequent stage of the filter is not contained in the Dewar 12, but the amplifier may be contained inside the Dewar 12. Moreover, for simplicity, FIG. 3 shows an example in which only one planar filter is disposed inside the Dewar 12, but a plurality of filters can be contained as shown by dotted lines of FIG. 3.

An operation of the first embodiment of the planar filter shown in FIG. 1 will next be described. Factors for determining the pass frequency band of the planar filter of FIG. 1 are a length of the resonance element 6, and an effective permittivity $\in$ and an effective permeability of a medium surrounding the resonance element 6. Moreover, the skirt property and ripple are defined by an unloading Q value of the resonance element 6, coupling between the resonance elements 6, and coupling between the resonance element 6 and the input/output portion 5.

The coupling between the resonance elements 6, and the coupling between the resonance element 6 and the input/output portion 5 are determined by gap lengths, and the effective permittivity $\in$ and effective permeability $\mu$ of the medium surrounding the gaps. When the direct-current magnetic field is applied to the tuning member 2 of FIG. 1 by the external coil 15 shown in FIG. 3, the effective permeability $\mu$ entirely changes, and resonance frequencies of all the resonance elements 6 can uniformly be shifted.

Here, the resonance frequency f of the resonance element 6 is represented by equation (1) using the effective permittivity $\in$, effective permeability $\mu$, length L of the resonance element 6, and a velocity of light c.

$$f=c/2L\sqrt{\in\mu} \quad (1)$$

It is seen from the equation (1) that when the effective permeability $\mu$ changes, the resonance frequency f changes in accordance with change of the effective permeability. When the resonance frequency f changes, the filter pass frequency band also changes.

As described above, when the direct-current magnetic field is applied to the filter of FIG. 1 in the direction of the arrow Y1, the filter pass property shifts on a frequency axis, but the coupling between the resonance elements 6, and the electromagnetic coupling between the resonance element 6 and the input/output portion 5 also change, and the filter skirt property, ripple, and other filter properties are other than designed.

In this case, in the present embodiment, by applying the voltage between the electrodes 9 disposed in the vicinity of the dielectric thin films 8 of FIG. 1, the effective permittivity $\in$ of the gap between the resonance elements 6, or the gap between the resonance element 6 and the input/output portion 5 is variably controlled, and the skirt property and ripple are adjusted.

Moreover, in the present embodiment, since the dielectric with an electric field dependent permittivity with a large dielectric loss is used only in a portion disposed opposite to the gap between the resonance elements 6 or the gap between the resonance element 6 and the input/output portion 5, the unloading Q value of the resonance element 6, filter insertion loss, and skirt property are not seriously sacrificed.

A second embodiment is characterized in that the resonance frequency of the resonance element 6, coupling between the resonance elements 6, and coupling between the resonance element 6 and the input/output portion 5 can individually and independently be adjusted.

Figure 4A:
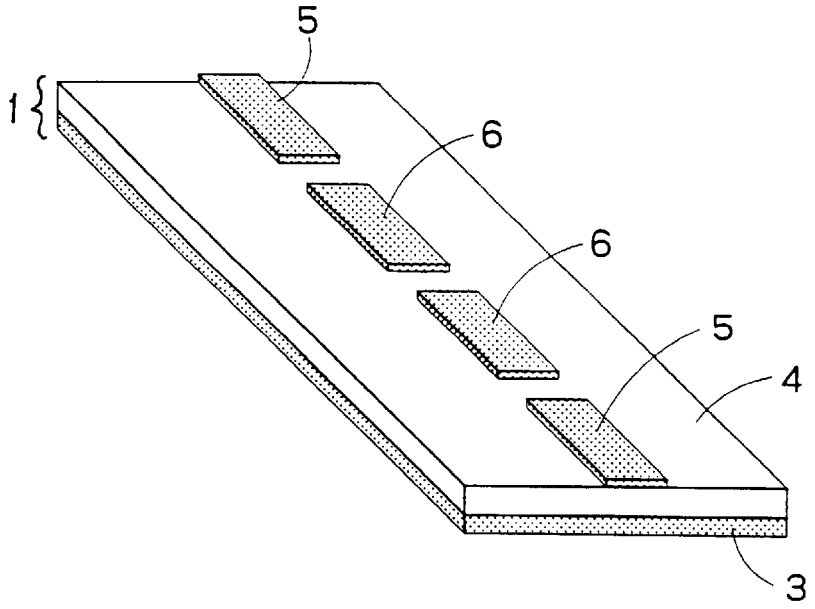
FIGS. 4A and 4B are views showing a second embodiment of the planar filter according to the present invention.
Figure 4B:
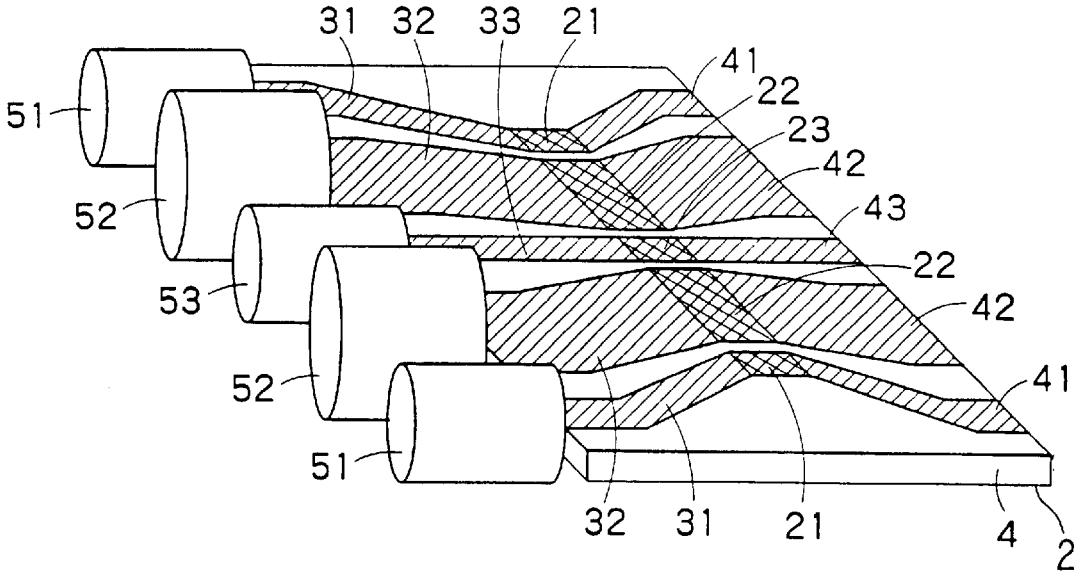
Figure 5:
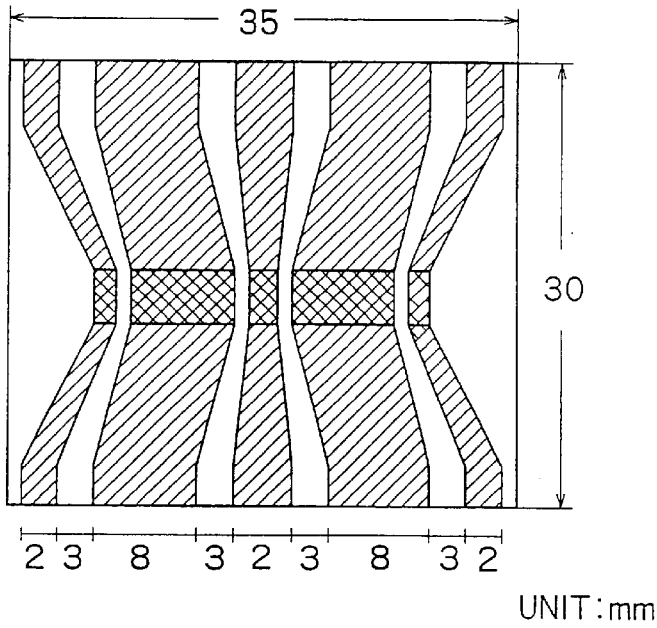
FIG. 5 is a plan view of the tuning member.

FIGS. 4A and 4B are views showing the second embodiment of the planar filter according to the present invention. FIG. 4A is a perspective view of the filter member 1; and FIG. 4B is a perspective view of the tuning member 2. Moreover, FIG. 5 is a plan view of the tuning member 2.

The planar filter of FIGS. 4A and 4B is characterized in that the structure of the tuning member 2 is different from that of the first embodiment (FIG. 1), and the structure of the filter member 1 is similar to that of FIG. 1.

The filter member 1 of FIG. 4A, similarly as FIG. 1 is characterized in that superconductors are formed on both surfaces of the substrate 4, one surface is used as a ground conductor 3, the superconductor on the other surface is processed, and a pair of input/output portions 5 and the plurality of resonance elements 6 are separately formed.

The tuning member 2 of FIG. 4B has a first magnetic material 21 disposed opposite to the gap between the input/output portion 5 and the resonance element 6, a second magnetic material 22 disposed opposite to the resonance element 6, a third magnetic material 23 disposed opposite to the gap between the resonance elements 6, fourth and seventh magnetic materials 31 and 41 disposed on both the sides of the magnetic material 21, fifth and eighth magnetic materials 32 and 42 disposed on both the sides of the magnetic material 22, sixth and ninth magnetic materials 33 and 43 disposed on both the sides of the magnetic material 23, and coils 51, 52 and 53 each connected to one end of each of the magnetic materials 31, 32 and 33.

The planar filter of FIGS. 4A and 4B is, similarly as FIG. 3, contained in the copper (Cu) container 11 and disposed inside the Dewar 12.

Figure 6:
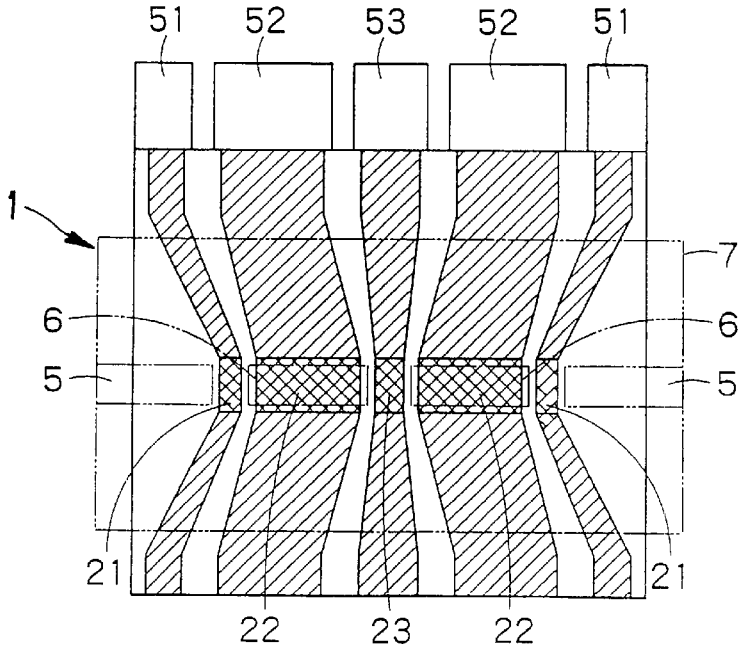
FIG. 6 is a view showing that the filter member is turned a over and disposed opposite to the tuning member.
Figure 14:
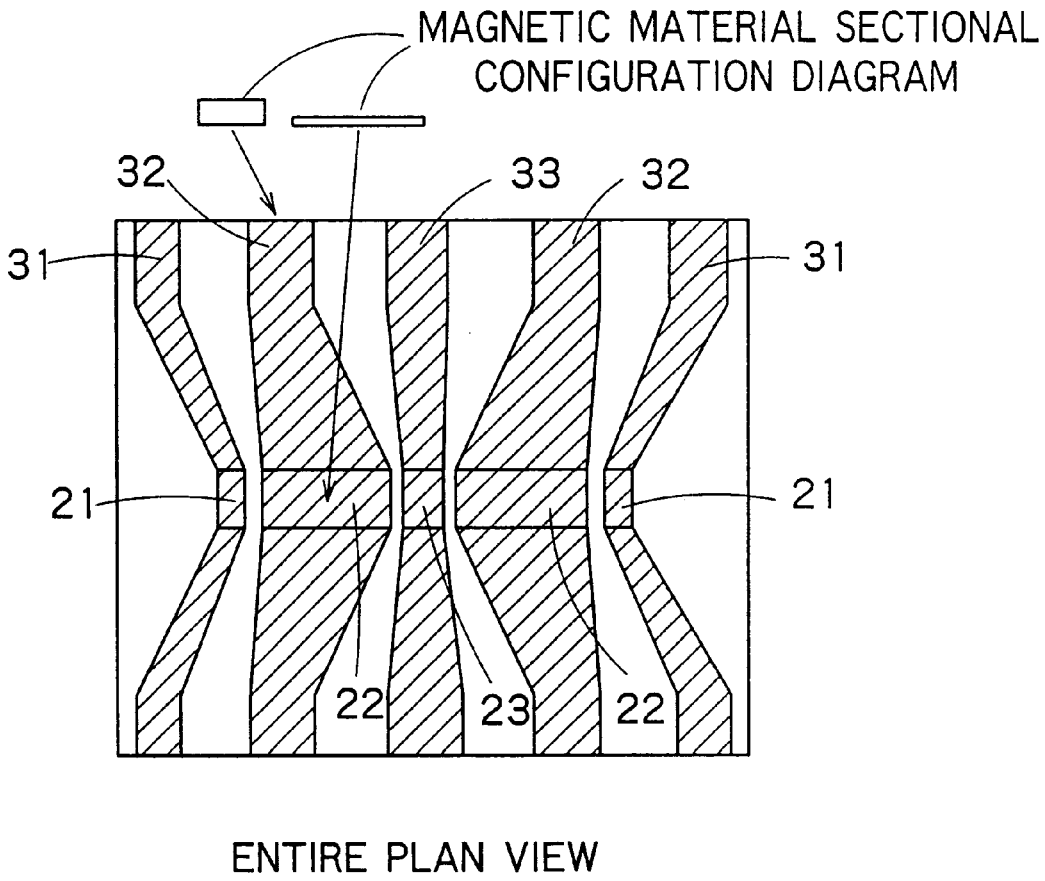
FIG. 14 is an explanatory view showing that a magnetic material sectional area is always set to be constant.

Either one of the filter member 1 or tuning member 2 is turned over and disposed opposite to the other member. FIG. 6 shows that the filter member is turned over and disposed opposite to the tuning member 2 (not shown in FIG. 6). As shown FIG. 6, the magnetic material 22 is disposed opposite to the resonance element 6, the magnetic material 23 is disposed opposite to the gap between the resonance elements 6, and the magnetic material 21 is disposed opposite to the gap between the resonance element 6 and the input/output portion 5. Moreover, as shown in FIG. 14, the magnetic elements 21–23 and 31–33 have a constant cross-sectional area. Other aspects of FIG. 14 are the same as FIG. 4B and, therefore, a detailed description of the structural elements common to FIGS. 4B and 14 are not repeated with respect to FIG. 14.

Additionally, in FIG. 4B, the magnetic materials 21 to 23 are shown separately from the magnetic materials 31 to 33, 41 to 43 by hatching, but the materials may be formed of different members, or the same member.

The magnetic materials 41 to 43 are disposed in such a manner that the magnetic field applied to the magnetic materials 21 to 23 is diffused in space at a place apart from the superconductors 5 and 6 on the filter member 1, and it is unnecessary to symmetrically dispose the magnetic materials 31 to 33 and the magnetic materials 41 to 43 via the magnetic materials 21 to 23.

Figure 7:
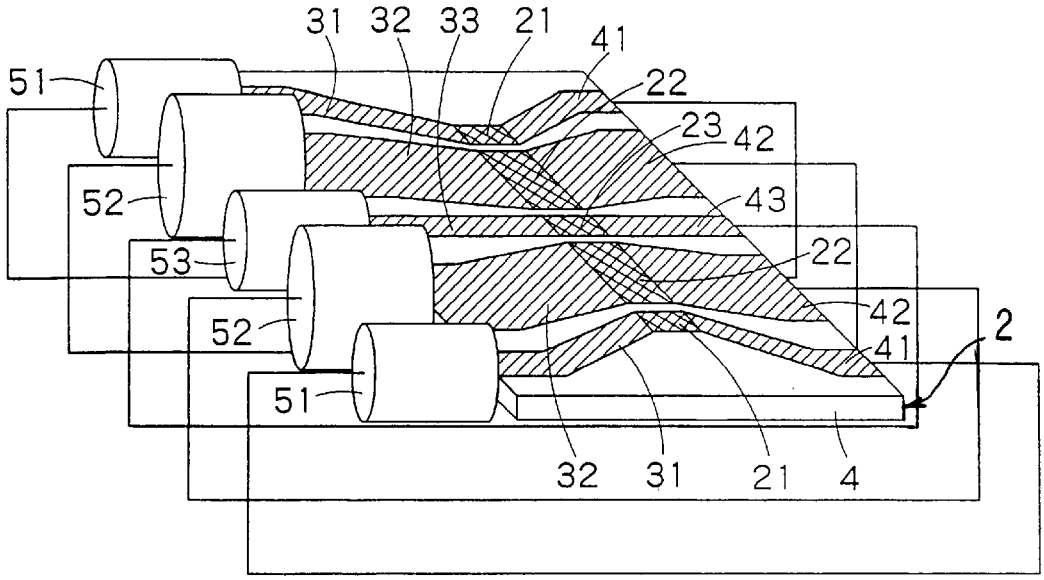
FIG. 7 is a view showing an example in which a magnetic material is also disposed on a back surface side of the tuning member to form a magnetic closed circuit.

Moreover, as shown in FIG. 7, the magnetic materials may also be disposed on the back surface of the tuning member to form a magnetic closed circuit, so that the magnetic field generated by the coil does not leak to the outside. By this structure, a leak magnetic flux is reduced, a superconductor property can be prevented from being deteriorated due to the magnetic field, and power supplied to the coils 51, 52, 53 can be reduced.

As shown in the aforementioned equation (1), main factors for determining the filter pass frequency are the length of the resonance element 6, and effective permittivity $\in$ and effective permeability $\mu$ in the vicinity of the resonance element 6. Moreover, main factors for determining the skirt property and ripple are the Q value of the resonance element 6, coupling amount between the resonance elements 6, and coupling amount between the resonance element 6 and the input/output portion 5.

Figure 8:
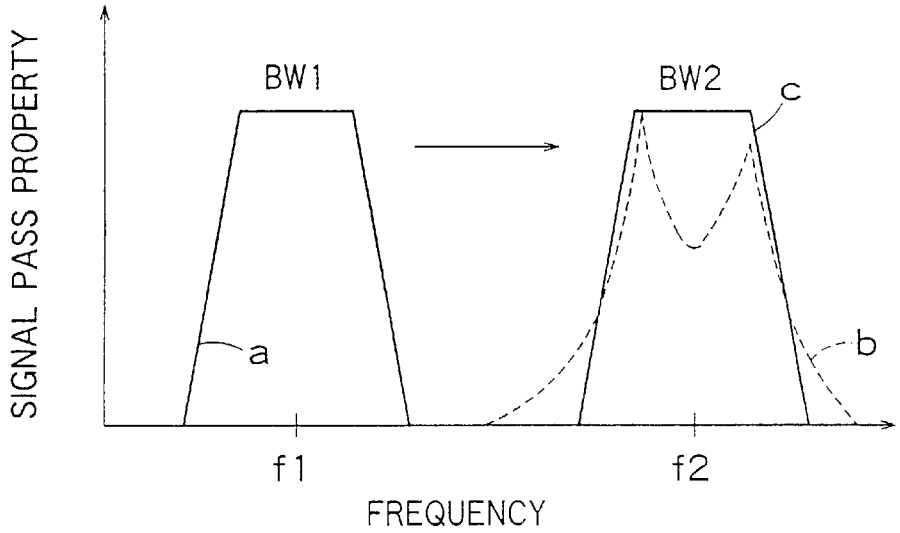
FIG. 8 is a chart showing a frequency pass property of the filter of the present embodiment.

FIG. 8 is a chart showing the frequency pass property of the filter of the present embodiment. When no magnetic field is generated by the coils 51, 52, 53 of FIG. 4B, as shown by a solid line a, at a center frequency f1, there is no ripple, and the skirt property is in a satisfactory state.

In this state, when the magnetic field is generated by the coil 52 of FIG. 4B, the permeability in the vicinity of the resonance element 6 changes, and the filter pass frequency band can be shifted to f2. However, since the coupling between the resonance elements 6 and the coupling between the resonance element 6 and the input/output portion 5 are set to values adapted to the pass frequency band before generation of the magnetic field by the coil 52 of FIG. 4B, simply by generating the magnetic field by the coil 52, as shown by a dotted line b of FIG. 8, the ripple is generated, and the skirt property is deteriorated.

Therefore, in the second embodiment, the magnetic field is generated by the coils 51 and 53 of FIG. 4B, and the permeability of the magnetic materials 21 and 23 is changed to a desired value. As a result, the coupling between the resonance elements 6 and the coupling between the resonance element 6 and the input/output portion 5 are set to the desired values, and as shown by a solid line c of FIG. 8, a satisfactory frequency property can be obtained.

Moreover, since the loss by the magnetic materials 21 to 23 is sufficiently small, the low-loss and sharp-cut filter property utilizing a superconductor characteristic is consistently maintained.

In the aforementioned first and second embodiments, the two-stage band pass filter has been described as an example, but the present invention can also be applied to filters with other numbers of stages. Moreover, a filter type is not limited to the band pass filter, and the present invention can also be applied to other types such as a band reject filter, a low pass filter, and a high pass filter. Furthermore, it is unnecessary to limit the filter shape characterizing a way of coupling to an end couple type, and the present invention can also be applied to other types such as a side couple. It is also unnecessary to limit the structure to the micro-strip line structure, and any other structure can be used as long as the length of the resonance element 6 and the gap determine properties, and the present invention can also be applied, for example, to a coplanar structure.

Concrete examples of the present invention will be described hereinafter.

FIRST CONCRETE EXAMPLE

A first concrete example described hereinafter is a concrete example of the filter of FIG. 1 described in the first embodiment, and a band pass filter of a micro-strip line structure of a 4.8 GHz band will be described.

In the present example, 0.5 mm thick LaAlO, was used as the substrate 4 of the filter member 1. A yttrium-based superconductor thin film was formed in 500 nm on both surfaces of the substrate 4 by a sputtering method, the superconductor thin film on one surface was used as the ground surface 3, the superconductor thin film of the other surface was processed using an ion milling method, the input/output portion 5 and a plurality of resonance elements 6 with a desired resonance frequency were formed, and the filter member 1 of the micro-strip line structure was prepared.

Each resonance element 6 obtained a width of 170 $\mu$m, length of 8 mm, and resonance frequency of 4.8 GHz. Moreover, a 100 $\mu$m gap was disposed between the resonance elements 6, and a 70 $\mu$m gap was disposed between the resonance element 6 and the input/output portion 5.

On the other hand, as the tuning member 2, a 7 nm thick oxide conductive film $SrRuO_3$ (hereinafter referred to as the SRO film) was first formed on the 0.5 mm thick magnetic plate 7 of $Y_3Fe_5O_{12}$ (YIG) with a saturation magnetization of 750 gausses by the sputtering method.

The SRO film was next processed using the ion milling method, and the pair of electrodes 9 with a linear width of 10 $\mu$m and a gap of 40 $\mu$m were formed on portions opposite to a gap portion between the resonance elements 6 of the filter member 1 and a gap portion between the resonance element 6 and the input/output portion 5.

Figure 9:
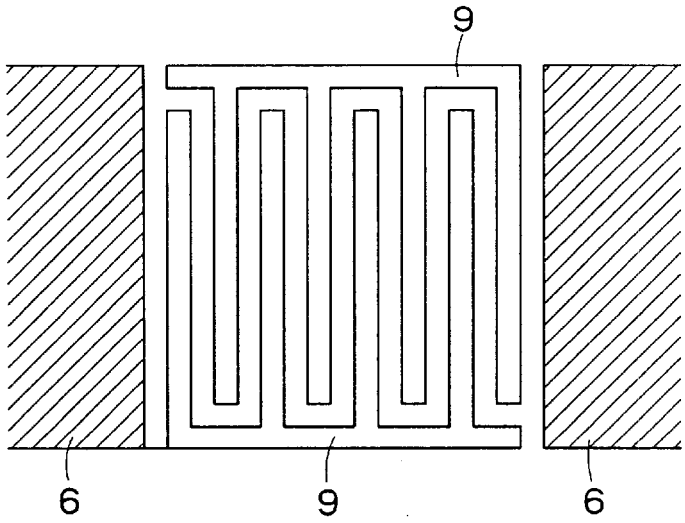
FIG. 9 is a view showing an example in which an electrode is formed in an inter-digital shape.

Subsequently, a metal mask was used, and the dielectric thin film 8 of $SrTiO_3$ (hereinafter referred to as the STO film) whose permittivity is dependent on the applied electric field was laminated on the portion opposite to the aforementioned gap portion in 500 nm by the sputtering method. The shape of the electrode 9 may be other than a two-line shape as shown in FIG. 1, or may be an inter-digital shape (comb shape) as shown in FIG. 9. As seen in this Figure, the electrode 9 positioned between the resonator elements 6 is an inter-digital shape.

Evaluation of the filter property was performed as follows. After assembling the filter member 1 and tuning member 2 prepared in the aforementioned process opposite to each other with a gap of 0.3 mm in the container 11, as shown in FIG. 3, the coil 15 was wound around the outer wall of the container 11.

Subsequently, the container 11 was disposed in the Dewar 12, connected to the refrigerator 13 which can cool to 40 K, cooling was performed to obtain 60 K, and pass property and reflection property of a microwave power were measured by a vector network analyzer.

Figure 10:
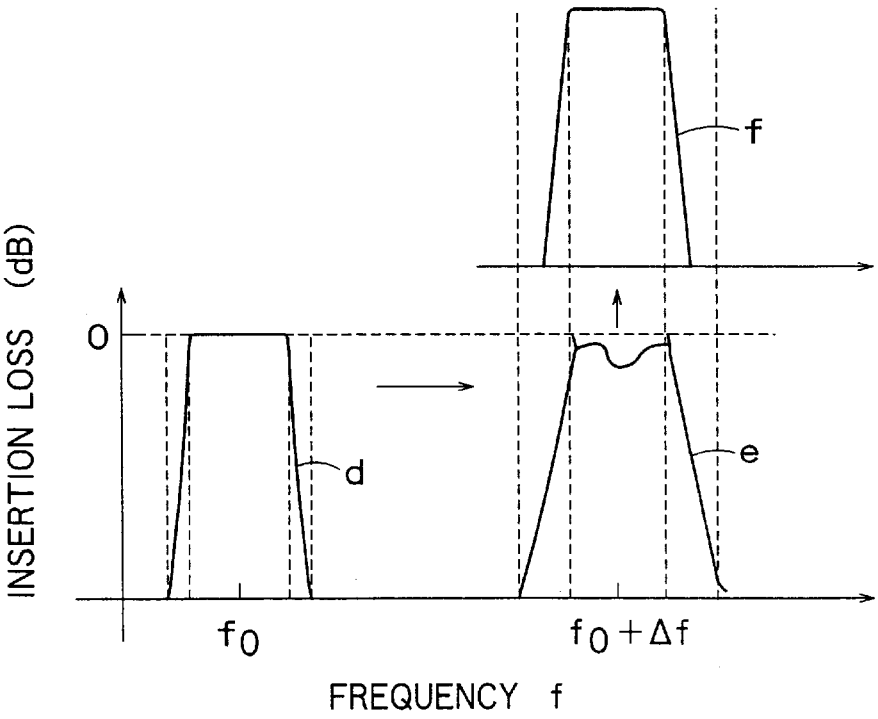
FIG. 10 is a chart showing a filter pass property.

In a state in which 80 V was applied to the voltage applying electrode 9 and no current was passed through the magnetic field applying coil 15, that is, in a state of zero magnetic field, as shown by a curve d of FIG. 10, the filter pass property was flat in the pass band, the insertion loss was 1 dB or less, a rise and a fall (skirt property) on both ends were steep, and a satisfactory filter property was shown.

Subsequently, when the current was passed to the magnetic field applying coil 15 of FIG. 3, and the magnetic field of 300 oersteds (Oe) was applied, as shown by a curve e, the center frequency of the pass band shifted to a high frequency side by $\Delta f$=38 MHz, but irregularity (ripple) increased in the pass band, and the skirt property was also deteriorated.

In this state, when the voltage applied to the voltage applying electrode 9 of FIG. 1 was set to 40 V, as shown by a curve f, the ripple was decreased while the pass band center frequency is ($f_o$+$\Delta f$), and the skirt property was improved, and the satisfactory filter property was shown.

In the present example, for simplicity of description, the applied voltage was 80 V at zero magnetic field as the initial state shown by the curve d, but when the applied voltage was 0V at the zero magnetic field, the pass band center frequency f was similar as shown by the curve d, but the property with a large ripple was obtained as shown by the curve e.

When the filter member 1 was disposed close to the tuning member 2, the frequency shift in case of applying the magnetic field of 300 oersteds (Oe) was 149 MHz which was about four times the aforementioned shift, and the insertion loss increased, but was 2 dB. Moreover, similarly as described above, the change of the filter property by frequency tuning is adjustable by applying the voltage for the dielectric by the voltage applying electrode 9.

As described above, since the filter of the present example can arbitrarily adjust the skirt property and ripple by the voltage applying electrode 9, the pass frequency band can variably be controlled over a broad range without deteriorating the filter properties such as the skirt property and ripple.

Moreover, in the present example, since the dielectric thin film as a cause for deterioration of the unloading Q value is used only in the limited portions such as the gap between the resonance elements 6, the loss reduction as the characteristic of the superconductor is not sacrificed.

Additionally, for the aforementioned first concrete example, as shown in FIG. 1, an example in which the planar filter member 1 and tuning member 2 are disposed parallel to each other has been described, but a case in which the filter member 1 is not disposed parallel to the tuning member 2 was also experimented. As a result, as compared with the parallel arrangement, the filter insertion loss increased, and no steep skirt property was obtained.

Moreover, in the aforementioned first concrete example structure, the magnetic material in the tuning member 2 disposed above (or below) the filter member 1 needs to cover the entire surface of the superconductor portion of the filter member 1, and in the structure for covering only a part the filter insertion loss increased and no steep skirt property was obtained.

SECOND CONCRETE EXAMPLE

A second concrete example described hereinafter is, similarly as the first concrete example, a concrete example of the first embodiment, and an example with a pass frequency band of about 2 GHz is shown.

Figure 11A:
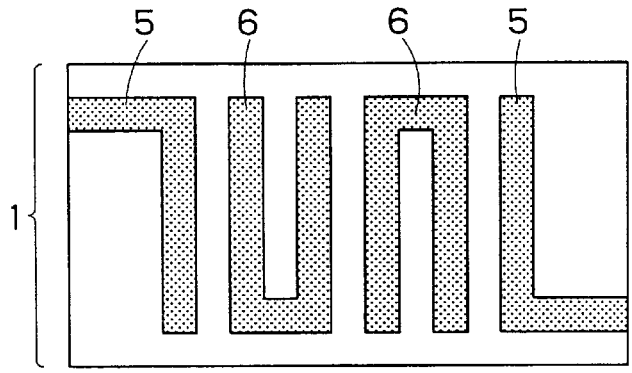
FIGS. 11A–11C are views showing a structure of a second example of the planar filter.
Figure 11B:
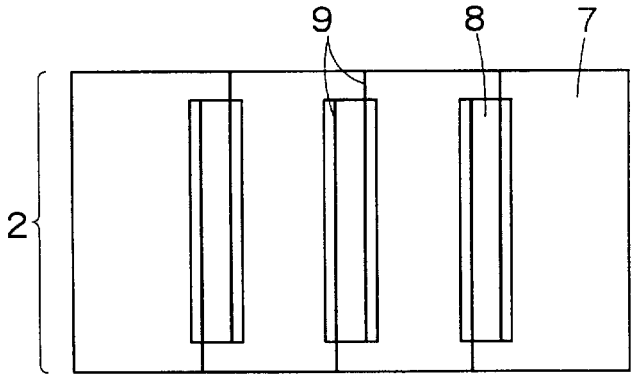
Figure 11C:
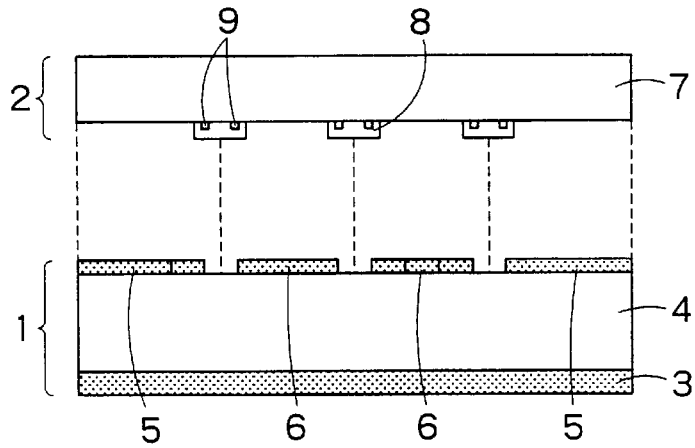

FIGS. 11A–11C are views showing a structure of the second concrete example of the planar filter. FIG. 11A is a plan view of the filter member 1, FIG. 11B is a plan view of the tuning member 2, and FIG. 11C is a sectional view of the planar filter.

The planar filter of FIGS. 11A and 11C are similar in structure and manufacture method to the planar filter of FIG. 1, except that the shape of the resonance element 6 on the filter member 1 is different. Therefore, a detailed description of the elements shown in FIGS. 11A–11C has been provided with respect to FIG. 1 and is not repeated in relation to FIGS. 11A–11C.

As shown in the equation (1), when the resonance frequency is lowered, the length L of the resonance element 6 is lengthened. Therefore, in the filter member 1 of FIG. 11A, the resonance element 6 is lengthened by folding and disposing the resonance element 6.

In the present example, the width of the resonance element 6 on the filter member 1 was set to 170 $\mu$m, the length was 20.2 mm, the gap between the resonance elements 6 was 1.2 mm, and the gap between the resonance element 6 and the input/output portion 5 was 340 $\mu$m. As a result, the same property was obtained.

Figure 12:
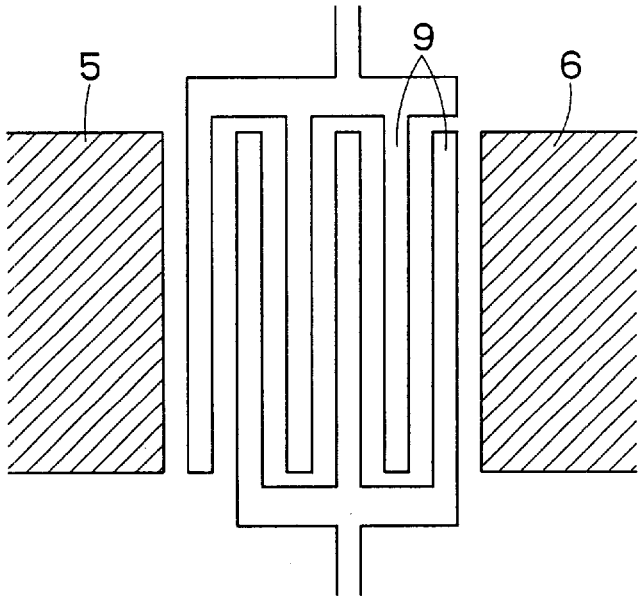
FIG. 12 is a view showing an example in which the electrode is formed in the inter-digital shape.

The applicant performed the experiment on condition that the electrode 9 of the tuning member 2 is, as shown in FIG. 12, formed in the inter-digital shape, the linear width of the electrode 9 is set to 10 $\mu$m, the linear gap was 40 $\mu$m, the number of electrodes 9 between the resonance elements 6 is 24 pieces, the number of electrodes 9 between the resonance element 6 and the input/output portion 5 is six pieces, and the gap between the filter member 1 and the tuning member 2 is set to 0.3 mm.

In case of the band pass filter of a 2 GHz band, when the saturation magnetization of the magnetic material is set to 750 gausses similarly as the filter of 4.8 GHz, the insertion loss was 20 dB or more, and the filter could not bear its use. For the band pass filter of the 2 GHz band, by setting the saturation magnetization of the magnetic material to 300 gausses or less, the insertion loss obtained a practical level of 1 dB or less.

With changes of the voltage applied to the electrode 9 and applied magnetic field, the filter property change was similar to that of the first concrete example, but the center frequency with an applied magnetic field of 300 Oe changed by 38 MHz.

When a relation between the filter pass frequency f (MHz) and magnetic material saturation magnetization 4 $\pi$Ms (gauss), and the insertion loss and filter property was checked, and when the saturation magnetization 4 $\pi$Ms of the magnetic material used in the filter with the pass frequency f deviate from a condition of 4 $\pi Ms<f/6.3$, the insertion loss of the planar band pass filter of the present invention rapidly increased, and the skirt property was also moderated.

THIRD CONCRETE EXAMPLE

A third concrete example described hereinafter is a concrete example of the filter of FIGS. 4A and 4B described in the second embodiment.

In the third concrete example, the planar filter shown in FIGS. 4A and 4B was prepared in the following method. On both surfaces of the single-crystal substrate 4 of $LaAlO_3$ with a longitudinal size of 40 mm, lateral size of 20 mm and thickness of 0.5 mm, a 500 nm thick YBCO superconductor film was formed by the sputtering method, laser vapor deposition method, CVD method, or the like. Next, one surface was processed by a lithography method to form the input/output portion 5 and resonance element 6, and then the back surface of the substrate was used as the ground surface 3 and a two-stage band pass filter of a micro-strip structure was prepared.

The width of the resonance element 6 was set to 170 $\mu$m, the length thereof was 8 mm, the gap between the resonance elements 6 was 100 $\mu$m, and the gap between the resonance element 6 and the input/output portion 5 was 50 $\mu$m.

Moreover, the tuning member 2 shown in FIG. 4B was prepared in the following method. Over the entire top surface of the nonmagnetic ceramic substrate 4 with a longitudinal size of 35 mm, lateral size of 30 mm, thickness of 1 mm, a magnetic material composed of $Y_3Fe_5O_{12}$ (YIG) was formed to obtain a thickness of 100 $\mu$m by an application method.

Subsequently, a laser beam processor was used to process the YIG thick film with dimensions shown in FIG. 5 to obtain the form of FIG. 4B. FIG. 5 illustrates the dimensions of the structure in FIG. 4B and therefore the structural features described with respect to FIG. 4B are not repeated in relation to FIG. 5.

Subsequently, the magnetic field generating coils 51 to 53 as shown in FIG. 4B were disposed in the vicinity of the magnetic materials 31 to 33 using a fixing jig (not shown). For the coils 51, 53, an inner diameter was set to 2 mm, and outer diameter was set to 4 mm, length was set to 5 mm. For the coil 52, the inner diameter was set to 3 mm, outer diameter was set to 10 mm, and length was set to 10 mm.

For each of these coils 51 to 53, a conductor with a diameter of 0.1 mm was wound 800 times per 1 cm, so that the magnetic field of about 100 Oe was generated by direct-current energizing of 100 mA.

Figure 13:
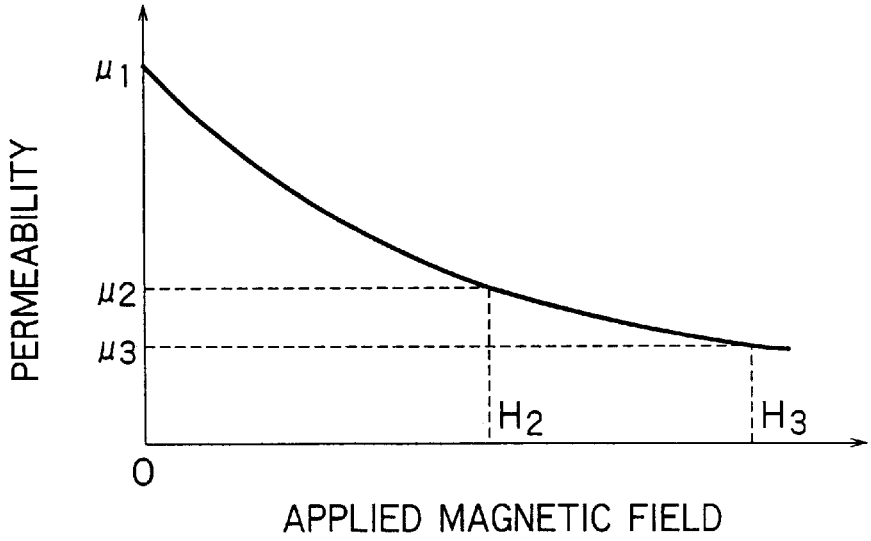
FIG. 13 is a chart showing the permeability of YIG.

Generally, when the magnetic field is applied to the YIG magnetic material, YIG permeability changes as shown in FIG. 13. Specifically, the permeability with the zero magnetic field monotonously decreases with magnetic field application.

Subsequently, the filter member 1 shown in FIG. 4A is overlapped onto the tuning member 2 shown in FIG. 4B in such a manner that the surface with the resonance element 6 formed thereon is opposite to the surface with the magnetic materials 21 to 23 formed thereon.

Specifically, the magnetic material 21 is disposed opposite to the gap between the resonance element 6 and the input/output portion 5, the magnetic material 22 is disposed opposite to the resonance element 6, and the magnetic material 23 is disposed opposite to the gap between the resonance elements 6. The planar filter of the present example was prepared in this manner.

FIG. 8 is a chart showing a pass property when the filter of the present example is cooled to 40 K. When no magnetic field is applied, the center frequency f1 of the pass frequency band is 4.8 GHz, and band width (BW1) is 15 MHZ.

In this case, the pass frequency band was flat and had substantially no ripple, and the insertion loss was 1 dB or less. Moreover, the property (skirt property) of the rise and fall portions on both the sides of the pass frequency band was steep. Because of this, a considerably satisfactory band pass filter property was shown.

Subsequently, by passing a current of 100 mA through the coil 52, and generating a magnetic field of 100 Oe, the magnetic field was applied to the magnetic material 22. As a result, as shown by the broken line b of FIG. 8, the center frequency f2 of the pass frequency shifted to the high frequency side by 20 MHz, but a ripple of 2 dB (recess portion) was generated in the pass band, and the skirt property was also deteriorated.

Furthermore, in this state, by passing a current of 30 mA through the coil 51 and a current of 40 mA through the coil 53, the magnetic field was applied to the magnetic materials 21 and 23. The result is shown by the solid line c of FIG. 8. The center frequency f2 of the pass frequency band was unchanged, the ripple was eliminated, the skirt property was improved, and the satisfactory band pass filter property was obtained as shown by BW2.

Additionally, in the present example, the initial state in which the filter property is satisfactory in all magnetic fields of zero has been described, but the constitution can also be designed in such a manner that the filter property is in the satisfactory initial state while the magnetic fields are generated by some coils.

Generally, the permeability of YIG monotonously decreases with respect to the applied magnetic field as shown in FIG. 12 . Therefore, it is also useful to design beforehand an initial state with an intermediate magnetic field applied thereto (e.g., a magnetic field value as shown by H2 of FIG. 12), so that adjustment is possible in a direction in which the permeability increases or decreases.

For the magnitude of the magnetic field generated in each of the coils 51 to 53 for adjustment of the pass frequency property, a control method of trial and error can be considered in which, for example, the pass property is monitored by the network analyzer in real time.

However, if conducting tests beforehand to set energizing current values of the respective coils 51 to 53 with respect to a postulated filter property, and preparing a type of calibration table, it is possible at the next time to quickly adjust the filter property based on the calibration table.

Moreover, when normal conductive metals are used as materials of the coils 51 to 53, power consumption occurs during energizing, and a method of preparing the coil of a superconductor wire and inhibiting the power consumption is therefore effective. In the present example, the YIG thickness was set to 100 $\mu$m, but actually the thickness is supposedly in a range of several tens of nanometers to several millimeters.

Furthermore, in order to reduce the loss, the magnetic materials 21 to 23, 31 to 33, 41 to 43 are preferably formed to be as thin as possible in accordance with a necessary change amount of permeability. A film forming method is not limited to the application method, and with a small thickness of several micrometers or less, the film may be formed by the sputtering method, laser vapor deposition, or CVD method.

Additionally, when each of the magnetic materials 21 to 23, 31 to 33, 41 to 43 is formed in a thickness of 100 $\mu$m or more, a bulk material may be placed onto the substrate 4. Moreover, when the magnetic material itself has a sufficient rigidity, the material does not have to be formed on the substrate 4, and may be prepared alone.

In the present example, the magnetic materials 21 to 23, 31 to 33, 41 to 43 are continuously prepared using the same material in the same thickness, but the thickness may be changed. For example, in order to form the magnetic material 32 within the compact inner diameter of the coil, it is proposed to reduce the width of the portion in the vicinity of the coil. In this case, when the thickness is the same as that of the magnetic material 22, the sectional area of the magnetic material in the vicinity of the coils 51 to 53 becomes smaller than the sectional area of the magnetic material 22.

Since the filter shown in FIGS. 4A and 4B conducts the magnetic field through the magnetic materials 21 to 23, 31 to 33, 41 to 43, the number of magnetic flux lines is always kept to be constant. Moreover, since magnetic flux density is in reverse proportion to the sectional area, with the sectional area of the magnetic material 22 larger than the sectional area in the vicinity of the coils 51 to 53, the magnetic flux density is reduced, and there is a possibility that a sufficient permeability change cannot be obtained.

Therefore, for the magnetic materials 31 to 33 of FIG. 7, as shown in FIG. 13, a technique of increasing the thickness in the vicinity of the coils 51 to 53, so that the sectional area is unchanged as a result, is effective to obtain a sufficient permeability ($\mu$) change. As seen in FIG. 13, the applied magnetic field $H_2$ corresponds to the permeability $\mu_2$, while a larger applied magnetic field $H_3$ corresponds to permeability $\mu_3$ on the permeability curve $\mu_1$. Moreover, in order to obtain a larger permeability ($\mu$) change, the sectional area in the vicinity of the coils 51 to 53 may be enlarged.

Furthermore, in the aforementioned first to third concrete examples, YIG has been described as an example of the magnetic material, but the magnetic material is not limited to YIG. Examples of the magnetic material other than YIG include $Y_3Fe_5O_{12}$, $Pr_{0.85}Ca_{0.15}MnO_3$, and $Nd_{0.67}Sr_{0.33}MnO_3$.

Additionally, the magnetic material has been described using the bulk plate, but a thin film obtained on the appropriate substrate 4 by various film forming methods, or a thin film formed on the filter member 1 may be used.

Furthermore, a signal frequency to be filtered by the aforementioned filter is not particularly limited, but a signal up to about several tens of gigahertz can be filtered, and the present filter can therefore be applied to a frequency band utilized by a cellular phone, or the like.

What is claimed is:

1. A planar filter comprising:

a filter member having a plurality of resonance elements composed of superconductor films and input/output portions disposed to sandwich said resonance elements via gaps on a dielectric substrate; and a tuning member composed of a magnetic material, said tuning member disposed opposite to said filter member via a predetermined gap and to which a direct-current magnetic field is applied, said tuning member comprising a permittivity adjusting section which adjusts an effective permittivity of at least one of a gap periphery between said resonance elements and a gap periphery between sand input/output portion and said resonance element, wherein a direct-current magnetic field is applied from said input/output portion arranged on one end side of said dielectric substrate to said input/output portion arranged on the other end side of said dielectric substrate.

2. The planar filter according to claim 1 wherein said permittivity adjusting section comprises:

a dielectric portion disposed opposite to at least one of said gap between said resonance elements and said gap between said input/output portion and said resonance element; and an electric field generating portion for generating an electric field in said dielectric portion.

3. A filter system comprising:

a container containing the planar filter according to claim 1;

a winding wound around an outer wall of said container, said winding applying a direct-current magnetic field along said gap between said filter member and said tuning member; and a refrigerator for cooling said container.

4. The planar filter according to claim 1, wherein said tuning member is formed using at least one of $Y_3Fe_5O_{12}$, $Pr_{0.85}Ca_{0.15}MnO_3$ and $Nd_{0.67}Sr_{0.33}MnO_3$.

5. The planar filter according to claim 1, wherein said filter member is a band pass filter of a micro-strip line structure in which a pair of said input/output portions composed of superconductors and said plurality of resonance elements composed of the superconductors are arranged on the substrate with a rear face side as a ground surface.

6. The planar filter according to claim 1, wherein a microwave signal is inputted to an input end of said input/output portion.

7. A planar filter comprising:

a filter member having a plurality of resonance elements composed of superconductor films and input/output portions disposed to sandwich said resonance elements composed via gaps on a dielectric substrate; and a tuning member disposed opposite to said filter member via a predetermined gap, said tuning member having:

a first magnetic material disposed opposite to a gap between said input/output portion and said resonance element;

a second magnetic material disposed opposite to each of said resonance elements;

a third magnetic material disposed opposite to a gap between said resonance elements; and magnetic field generation structure adjusting permeability of said first, said second and third magnetic materials, wherein a direct-current magnetic field is applied from said input/output portion arranged on one end side of said dielectric substrate to said input/output portion arranged on the other end side of said dielectric substrate.

8. The planar filter according to claim 7 wherein said tuning member is formed using at least one of $Y_3Fe_5O_{12}$, $Pr_{0.85}Ca_{0.15}MnO_3$ and $Nd_{0.67}Sr_{0.33}MnO_3$.

9. The planar filter according to claim 8, wherein said permittivity adjusting section variably controls a voltage to be applied to said electric field generating portion to variably control the effective permittivity of at least one of said gap between said resonance elements and said gap between said resonance element and said input/output portion.

10. The planar filter according to claim 7 wherein said magnetic field generation structure has first, second and third coils for applying magnetic fields to said first, second and third magnetic materials independently.

11. The planar filter according to claim 10 wherein said magnetic field generation structure individually controls currents for energizing said first, second and third coils, respectively to adjust a filter ripple, skirt characteristic and a center frequency.

12. The planar filter according to claim 10 wherein said filter member has n (n is an integer of 2 or more) pieces of resonance elements, and said tuning member has said third magnetic material disposed opposite to (n−1) gaps, each gap being between said adjacent resonance elements, and said third coils corresponding to these third magnetic materials.

13. The planar filter according to claim 10 wherein said tuning member comprises:

a fourth magnetic material disposed between said first coil and said first magnetic material, and connected to both of said first coil and said first magnetic material;

a fifth magnetic material disposed between said second coil and said second magnetic material, and connected to both of said second coil and said second magnetic material;

a sixth magnetic material disposed between said third coil and said third magnetic material, and connected to both of said third coil and said third magnetic material;

a seventh magnetic material disposed on a side opposite to said fourth magnetic material by sandwiching said first magnetic material, and connected to said first magnetic material;

an eighth magnetic material disposed on a side opposite to said fifth magnetic material via said second magnetic material, and connected to said second magnetic material; and a ninth magnetic material disposed on a side opposite to said sixth magnetic material by sandwiching said third magnetic material, and connected to said third magnetic material.

14. The planar filter according to claim 13 wherein said first, second and third coils, said fourth, fifth and sixth magnetic materials connected to the respective coils, said first, second and third magnetic materials connected to said fourth, fifth and sixth magnetic materials, and said seventh, eighth and ninth magnetic materials connected to said first, second and third magnetic materials form closed circuits, respectively.

15. The planar filter according to claim 13 wherein each of said fourth, fifth, sixth, seventh, eighth and ninth magnetic materials have a constant sectional area.

16. The planar filter according to claim 15 wherein said fifth magnetic material has a narrower width and a larger thickness on a far side from said second magnetic material than those on a close side to said second magnetic material.

17. The planar filter according to claim 15 wherein said fourth and sixth magnetic materials has a broader width and a smaller thickness on a far side from said first and third magnetic materials than those on a close side to said first and third magnetic materials.

18. The planar filter according to claim 7 wherein said filter member is a band pass filter of a micro-strip line structure having a pair of said input/output portions composed of superconductors and said plurality of resonance elements composed of the superconductors are arranged on the substrate on which a rear face side is fixed a ground potential.

19. The planar filter according to claim 7 wherein a microwave signal as a filtering object is inputted to an input end of said input/output portion.

* * * * *